United States Patent [19]

Mackiernan

[11] 4,111,351

[45] Sep. 5, 1978

[54] PAPERBOARD CARTON

[75] Inventor: Stuart W. Mackiernan, Canton, Mass.

[73] Assignee: BesPak Corporation, Greenwich, Conn.

[21] Appl. No.: 790,454

[22] Filed: Apr. 25, 1977

[51] Int. Cl.[2] ..... B65D 5/76

[52] U.S. Cl. ..... 229/17 M; 222/364; 222/535

[58] Field of Search ..... 229/17 M; 222/364, 363, 222/362, 535, 536, 542

[56] References Cited

U.S. PATENT DOCUMENTS

| | | | |
|---|---|---|---|
| 968,717 | 8/1910 | Vaughan | 229/17 M |
| 2,610,770 | 9/1952 | Penfield | 229/17 M |
| 2,613,856 | 10/1952 | Ely | 222/364 |
| 2,912,788 | 11/1959 | Hargrove | 229/17 M |
| 3,107,936 | 10/1963 | Parsons | 222/364 X |
| 3,511,416 | 5/1970 | Michie | 222/364 X |
| 3,831,833 | 8/1974 | Dressler | 229/17 M |

*Primary Examiner*—Davis T. Moorhead

[57] ABSTRACT

A paperboard carton for dry, flowable products such as laundry soap, powdered milk and the like is characterized by a pour spout positioned within an opening in the side of the carton which spout is capable of containing a predetermined amount of material, sealing the opening in the carton after the spout container is filled, sealing the opening in the carton when not in use, and allowing a free flow of material when in a certain position. The spout is also composed of paperboard or similar material and is inexpensively assembled and shipped with the main carton. A special wiping and sealing mechanism ensures absence of leakage in the area of the spout. The spout is provided with an automatic locking arrangement which enables it to be shipped within the filled carton in a flat condition so as to create no voids within the carton and then be set up into a permanent pour spout by the user in one simple operation.

8 Claims, 15 Drawing Figures

PAPERBOARD CARTON

FIELD OF INVENTION

This invention relates to cartons for housing dry, granular products and more particularly, to a paperboard carton having a unique measuring and pouring spout capable of being shipped in a flat condition.

DESCRIPTION OF PRIOR ART

Paperboard cartons of various sizes and shapes are used in vast quantities to contain many consumer products ranging from breakfast cereals and other foodstuffs to laundry soaps and powdered detergents. One continuous problem which has plagued both manufacturer and consumer alike is the provision of a suitable pour spout for use with such boxes which is capable of pouring out a measured amount of product and which is simple and efficient to construct, ship and operate and compatible with present carton constructions and manufacturing facilities.

Few, if any, measuring devices have found commerical success to date. Most such devices are too expensive to install within standard cartons, require extensive modification to product filling equipment or carton manufacturing assembly lines, create a void within the carton which adversely affects carton volume or causes the measuring spout to collapse during handling and shipping, or do not allow for complete emptying of the carton.

Various other attempts have also been made to manufacture pour spouts, but most of them fail to achieve any sealing between the spout and the carton. As a result, manufacturers have resorted to arrangements which require die cutting a hole in the side of the box and thereafter inserting a tab or employing the original material to close the opening. This arrangement is most unsuitable for consumer satisfaction since product leakage is rampant and complete emptying of the box is often a major chore. Furthermore, a complete seal is rarely achieved. Still another attempt to satisfy this long standing problem involves the use of a metallic pour spout which is inserted into an opening in the side of the carton and hingeably mounted to the carton. This spout is sealed during shipping by a thin piece of paper which is removed by the consumer. The spout is then withdrawn by the user to expose the opening. A heavy handed consumer will easily but inadvertently yank it from the carton entirely and subsequent problems of replacing it are profound. Manufacture of the carton of course is non-standard since at some point in the assembly the prefabricated spout piece must be placed in the carton and sealed. In addition to the troublesome difficulty of connecting two dissimilar materials in a sealing arrangement, the use of a metal spout could cause certain chemical reactions with the contents of some cartons such as the harsh chemicals in laundry detergents. Moreover, such a device is incapable of providing premeasured volume within the spout itself and this, of course, is highly desired.

DESCRIPTION OF THE INVENTION

It is the primary object of this invention to provide a standard paperboard carton which includes a pour spout which may be used to provide a predetermined measured quantity of material with excellent precision or alternatively, may be used to free pour the contents of the carton.

It is another object of this invention to provide a paperboard carton having a pour spout of the same or similar material which is inexpensive to manufacture, capable of being shipped flat, simple to use by the consumer, provides an excellent sealing arrangement prior to, during, and after use and creates no voids within the carton during filling.

It is still another object of this invention to provide a carton having a spout, the assembly of which involves the standard scoring, cutting and glueing involved in the manufacture of a conventional paperboard carton.

These and other objects of the invention are satisfied by a paperboard carton comprising a plurality of side panels and a top and bottom panel which are folded and glued to form an enclosure. The carton is provided with an opening or hole in one panel, preferably the top portion of a side panel from which pouring is conventionally effected by a consumer. A measuring spout is positioned within the opening and is secured to the carton so as to be able to be rotated into and out of the opening. The spout consists of a front wall, a rear wall and two side walls thereby forming a container for receiving material from within the carton. The container volume will depend in part upon the size of the carton as well as the nature of the contents of the box and may be varied from carton to carton.

The spout is characterized by a number of unique and highly advantageous features. First of all, it is composed of a material the same as or similar to that of the carton thereby eliminating many of the problems experienced when the spout is composed of a dissimilar material. Using such a material enables the spout to be folded, scored, die cut and glued to the carton with the same manufacturing machinery used to manufacture the carton. The spout consists of a single unitary piece impressed with a plurality of fold lines and adapted to be folded into a container. The rear wall of the spout pivots about a fold line toward and away from the front wall to which it is joined at the fold line. During shipment of the carton to a filling station, the rear wall of the spout is flush against the front wall while the side walls are also flat thus causing no interference with the standard condition of the carton, i.e. flat, open both ends. At the filling station, the carton is set up and the top portion is glued so that it will receive the contents in an upside down position. The spout is also partially set up automatically with the carton and because the rear wall is still against the front wall, no void is created within the carton during the filling process. In fact, it is not until a consumer wishes to fill the spout during use that the rear wall is actually separated from the front wall to form the spout container. When this occurs, the rear wall is moved over the now upstanding side walls to a point where it is interlocked with the side walls and permanently locks into place to form the container. Thereafter the measuring spout container is moved as a unit into and out of the opening in the carton, each time receiving a refill of carton contents in an amount up to the volume of the measuring spout container. By placing the measuring spout container in a position about half way between its outermost and innermost points of travel, a free flow of material may be accomplished. This is occasioned by the use of a die cut opening at the upper part of the rear wall over which the material flows freely.

The spout is constructed such that the opening is at all times sealed, if desired. During shipment of the filled carton, both the front and rear walls of the spout are in contact and seal the opening. When the measuring spout container is formed by the user, the rear wall seals the opening when the spout container is pulled out of the carton and the front wall seals the opening when the spout container is pushed into the carton. In addition, the carton includes a wiper seal arrangement which prevents leakage at the edges of the spout, especially as it moves into and out of the carton. This wiper seal arrangement is accomplished by leaving die cut elements in the side edges of the carton spout opening which are folded inwardly over vertical score lines. The innermost edge of these folded elements contact the side walls of the spout container and prevent the contents of the carton from leaking past the side walls at the opening. In effect, these edges scrape along the side walls wiping them clean of material and thus prevent leakage.

As will be more fully explained hereinafter with reference to the drawings, the carton of the invention includes a number of other features such as a notched carton edge at the uppermost portion of the opening to minimize "packing up" of material within the carton at that location; a lip on the front wall of the spout container to facilitate consumer use of the spout; and a securing means which enables the spout to rotate into and out of the carton without detachment from the carton.

BRIEF DESCRIPTION OF THE DRAWINGS

The invention will be more fully understood and the objects more clearly satisfied by reference to the accompanying drawings, in which.

DETAILED DESCRIPTION OF THE DRAWINGS

Figure 1:
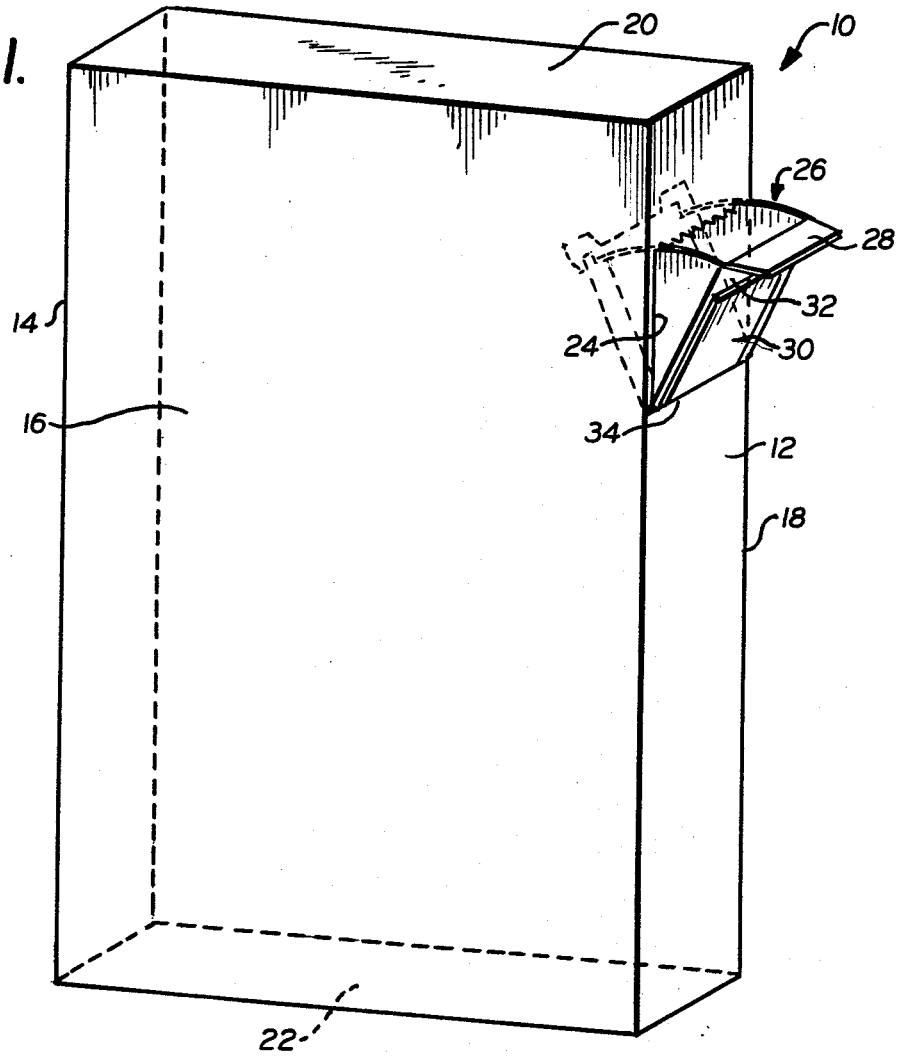
FIG. 1 is a perspective view of the carton of the invention including a spout in a fully assembled condition.

Referring now to the drawings, and first to FIG. 1, there a carton 10 is shown comprising a plurality of side panels 12, 14, 16, 18 a top panel 20 and a bottom panel 22. Side panel 12 includes an opening 24 near the top panel 20 within which a measuring spout generally designated by the numeral 26 is situated. The spout 26 is provided with a lip 28 which is easily grasped by a user and the spout 26 is moved toward or away from the carton 10 by the direction of pressure exerted on lip 28. The spout 26 is secured to a portion 30 of side panel 12 such as by gluing the portion 30 to front wall 32 of the spout. Portion 30 is rotatably movable about a score or fold line 34 and thus the spout is also rotatable within opening 24 since it is held to portion 30 over a substantial part of front wall 30 (See FIGS. 8 and 12). As can be seen from FIG. 1, the carton is provided with an easily operated pour spout, which as now will be explained, may be filled with a predetermined volume of material from the carton repeatedly or may be positioned to free pour the contents. The spout may be pushed to a fully internal position (FIG. 15) which allows the carton to assume a streamline exterior surface occupying no more storage space than normally, or it may be pulled to a fully extended position (FIG. 14) which is the position of pouring. Since the spout is also made of paperboard or a similar material, these frictionless movements may be effected by the consumer with little pressure whether or not the spout is filled with material.

Figure 2:
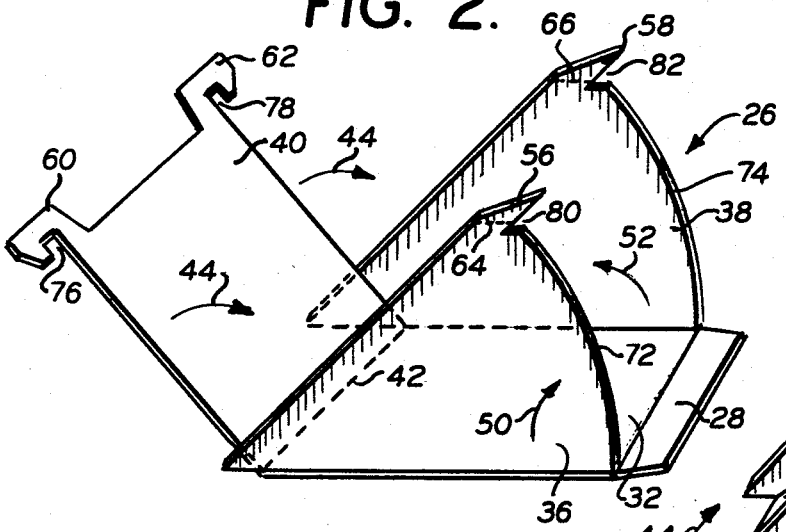
FIGS. 2, 3, 4 and 5 are perspective views of the spout which forms a part of the carton of FIG. 1 in various stages of assembly, with the fully assembled condition of FIG. 1 being illustrated in FIG. 5.
Figure 3:
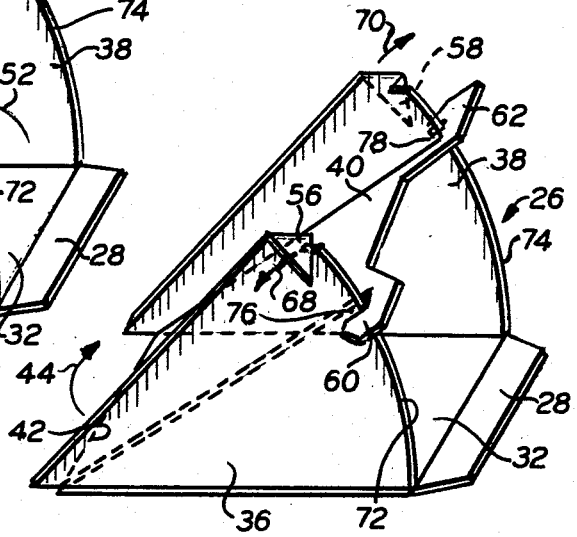
Figure 4:
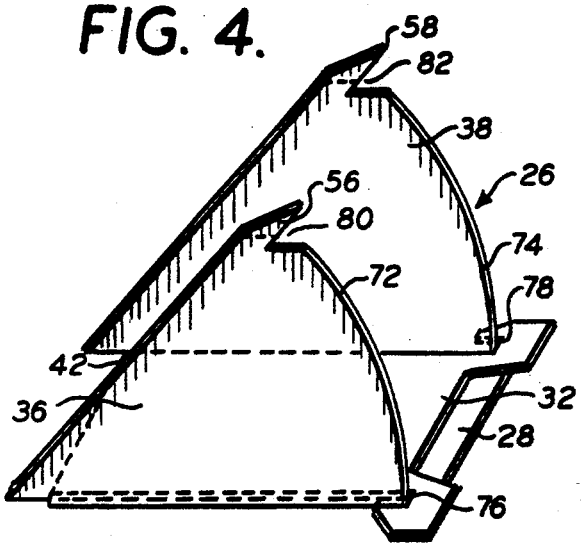
Figure 5:
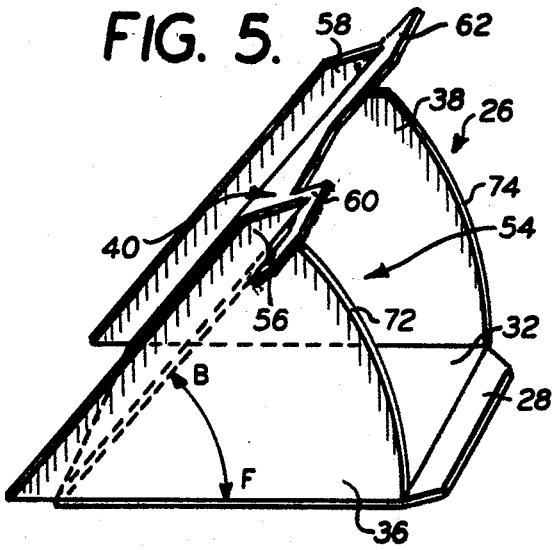
Figure 6:
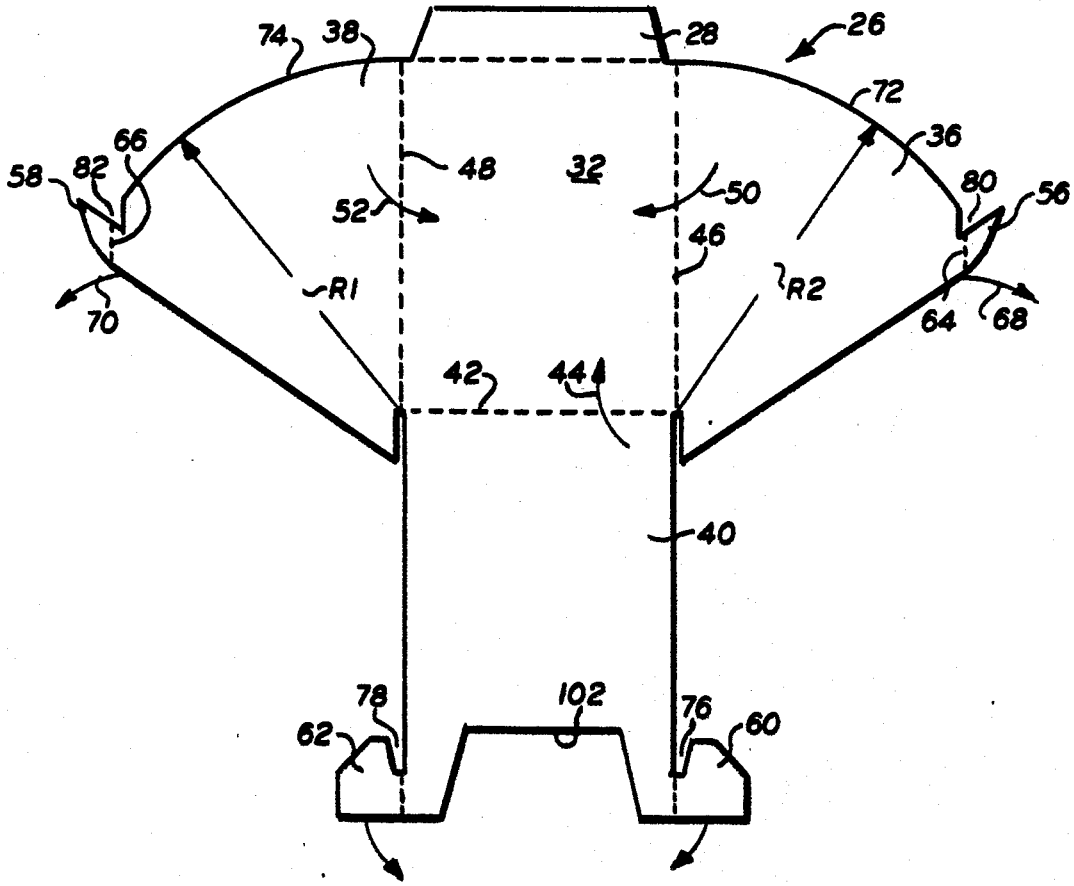
FIG. 6 is a plan view of the spout of FIGS. 1–5 prior to assembly.

The construction of the measuring spout 26 will now be explained with reference to FIGS. 2–6. Referring first to FIG. 6, the spout 26 is a single, unitary piece of paperboard as it is there illustrated in its flat condition. The spout includes a front wall 32, two side walls 36, 38 and a rear wall 40. A plurality of score or fold lines are impressed upon this piece by conventional machinery during manufacture thereof as shown by the dotted lines in FIG. 6. The score line 42 is placed at the junction of front wall 32 and rear wall 40 and this line 42 enables the rear wall to rotate in the direction of the arrow 44. This movement of the rear wall may also be described as being toward and away from front wall 32 and is best shown in FIGS. 2–4. It is this motion of rear wall 40 that permits the spout to achieve many of its versatile advantages. Referring again to FIG. 6, side walls 36 and 38 rotate over score lines 46 and 48 respectively in the directions of arrows 50 and 52. In their upstanding position, the side walls 36 and 38 appear as they do in FIGS. 2–5. It may be seen from FIG. 5, that once the side walls and rear wall are erected into the position there shown, the spout forms a container having a filling area 54 into which the contents of the carton may be supplied. This container volume 54 may of course be varied in size by varying the radius R1 and the radius R2 of the side walls 38 and 36 (FIG. 6) as well as by modifying the angle BF (FIG. 5). The angle B-F is suitably between 40° and 55° for most cartons.

The erection of spout 26 into the spout container having receiving area 54 will now be described by reference to FIGS. 2–6. Referring first to FIG. 2, the side walls 36 and 38 are folded upwardly to the position shown and held there. Rear wall 40 is then moved upwardly toward these side walls as shown. Tabs 56 and 58 on side walls 36 and 38 respectively must be moved out of the way in order for rear wall tabs 60 and 62 to clear these tabs. This is accomplished by folding tabs 56 and 58 over score lines 64 and 66 in the direction of arrows 68 and 70 (See FIG. 3). Once past tabs 56 and 58, rear wall 50 is now able to slide over the upper edges 72 and 74 of side walls 36 and 38 since these edges are now caught in tab grooves 76 and 78. The rear wall 70 may be moved at one end of travel to a position flush against front wall 32 (FIG. 4) which is the position assumed during shipping of the flat carton prior to erection as well as during the filing and shipping prior to setup by the consumer. At the other end of travel, this wall may be moved to the position shown in FIG. 5. This latter position is the position of spout used by the consumer. Once assuming the position shown in FIG. 5, the rear wall is locked there and will not be moved thereafter. This locking is accomplished as follows. Once rear wall 40 is past tabs 56 and 58, these tabs 56 and 58 are automatically erected to the position shown in FIGS. 2, 4 and 5 due to the resiliency of the paperboard material and the flexibility of these tabs initially about score lines 64 and 66. Once thus erected, tabs 56 and 58 form a blockage so that tabs 60 and 62 cannot again bypass them during normal operation. Moreover, these tabs each have a recessed or drop off groove shown by the numerals 80 and 82 best in FIGS. 2, 4 and 6. These grooves are constructed by altering the arcuate contour of edges 72 and 74 just in front of the tabs 56 and 58 so that these edges assume a linear or planar configuration for a short distance leading to the tabs. As a result of these configurations, the tabs 60 and 62 riding along edges 72 and 74 toward tabs 56 and 58 drop into grooves 80 and 82 and are interlockingly engaged with tabs 56 and 58 thereafter. During normal operation, the wall 40 will not be able to ride upwardly out of these grooves even when pressure from the carton contents is exerted on the rear wall 40. Thus the container area 54 is permanently formed and the user may fill, empty and refill this area without further dislocation of the parts of the spout.

Figure 13:
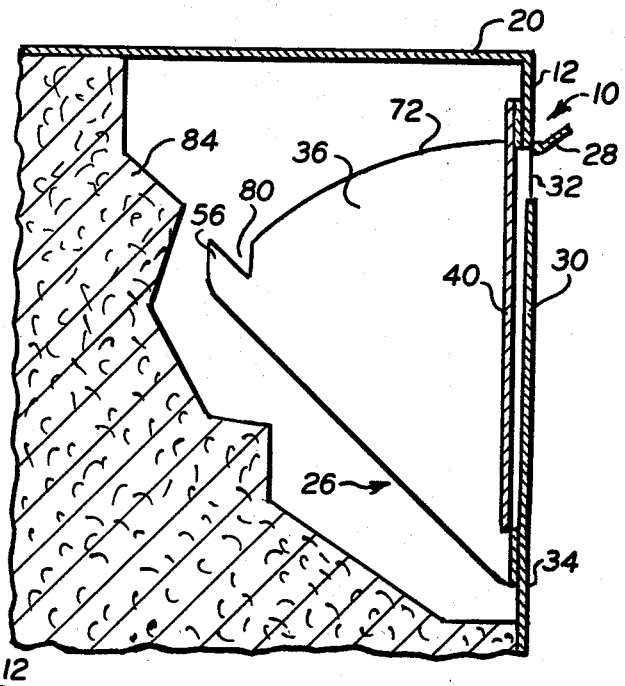
FIG. 13 is a side elevational view in cross section illustrating the spout within a filled carton as it is situated during shipping prior to the initial setup by a consumer.
Figure 14:
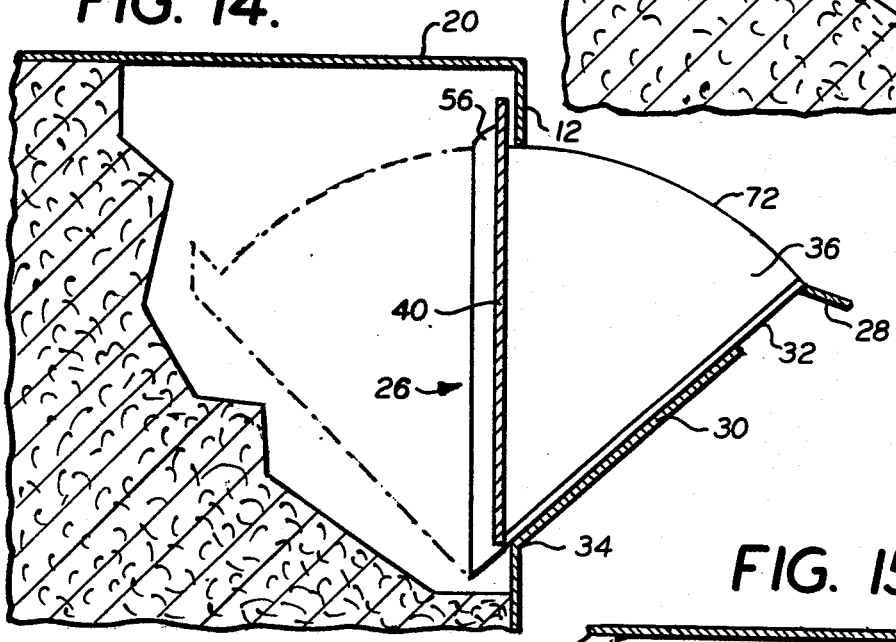
FIGS. 14 and 15 are side elevational views in cross section of the carton illustrating the spout during its outermost and innermost positions respectively, while being placed into use by a consumer.
Figure 15:
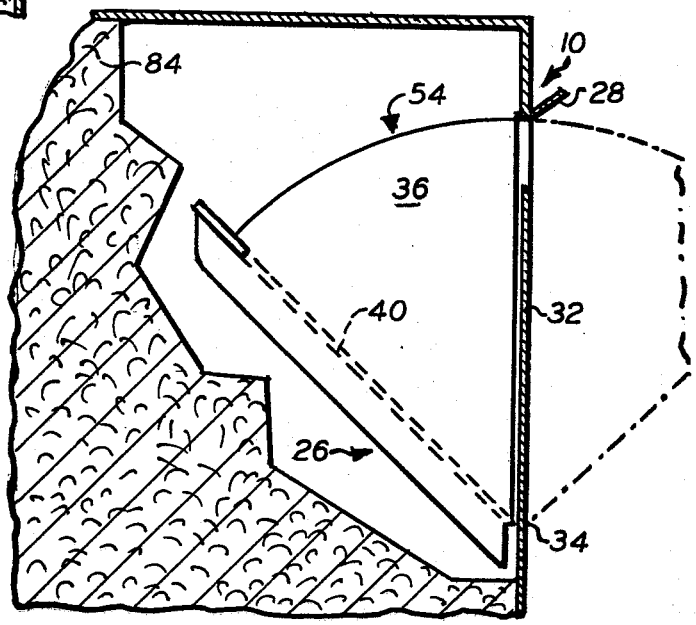

Reference to FIGS. 13, 14 and 15 will illustrate how the consumer forms the spout into a container with a minimum of effort. As shown in FIG. 13, the carton 10 is filled with a dry material 84 such as soap powder while the spout 26 is in its shipping condition. In that condition, rear wall 40 is flush against front wall 32 and side walls 36 and 38 are against carton panels 16 and 18. With this arrangement, the spout does not interfere with the filling, shipping, or handling of the carton. However, it is not ready for use by the consumer. To prepare it for use, the consumer need only pull the front wall 32 downwardly such as by pulling the lip 28 bringing the front and side walls to the full external position shown in FIG. 14. Rear wall 40 is held within the carton because its upper portion strikes the inside surface of panel 12 and is held against further movement out of the opening 24. As the front and side walls are pulled out of the carton, the rear wall effectively remains stationary and eventually locks into grooves 80 and 82 as explained with reference to FIG. 5. Now if the consumer pushes the spout back into the box, it moves as a unit with rear wall 40 permanently separated from front wall 32 as shown in FIG. 15. In this position, the box 10 need only be slightly tilted and the contents 84 will fill container area 54. If the spout is then withdrawn to the position shown in FIG. 14, the spout container will be ready for the pouring of its contents. In this way, a premeasured amount of contents 84 may be drawn from the carton as often as desired. It is important to note that at the extreme withdrawn or external position of the spout as shown in FIG. 14, the rear wall 40 seals opening 24 fully, while at the maximum internal position of the spout shown in FIG. 15, the front wall 32 fully covers opening 24. Thus the opening is sealed at both positions of the spout and this is highly advantageous to prevent leakage of contents 84.

Figure 7:
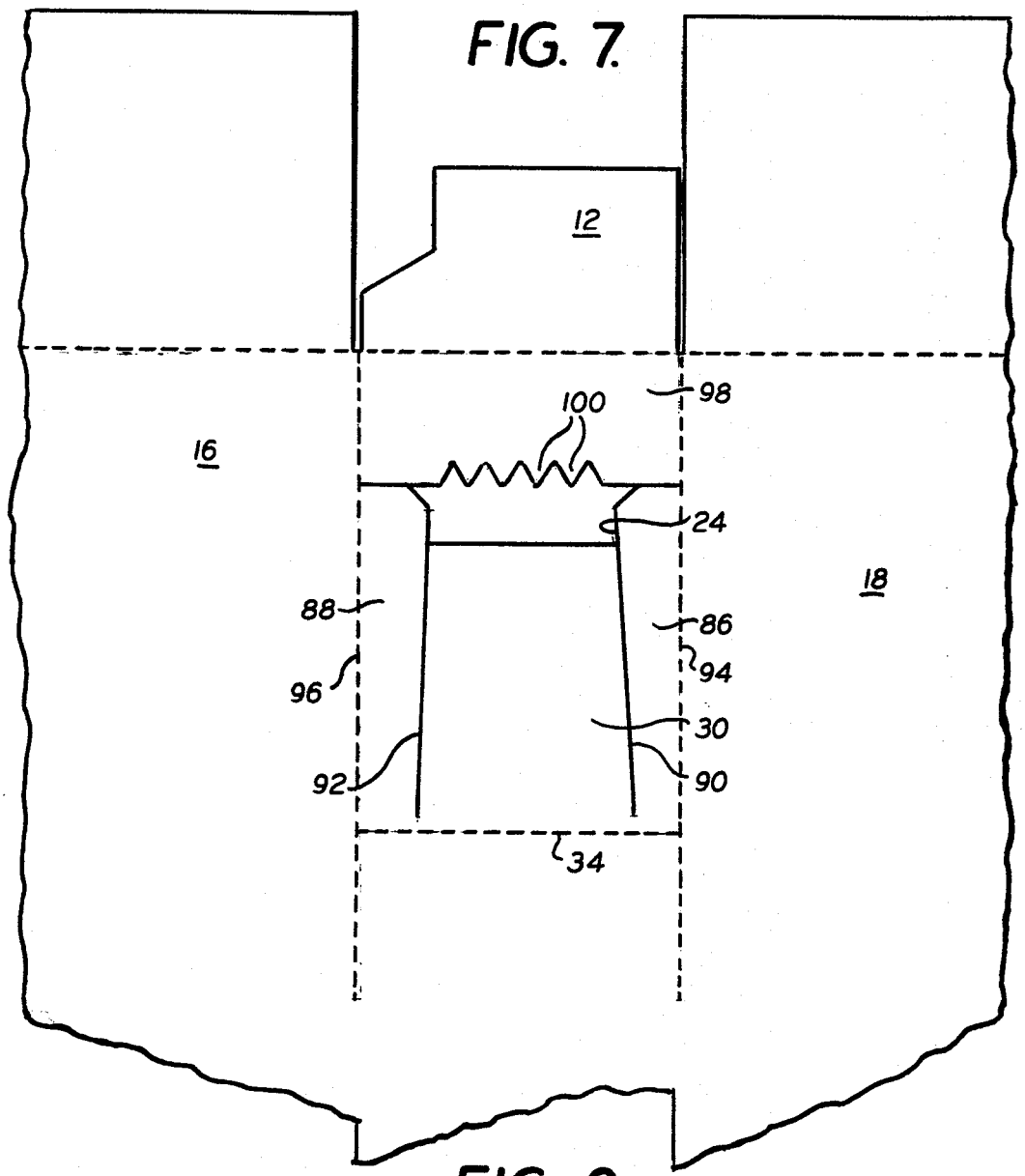
FIG. 7 is a plan view of that portion of the carton of FIG. 1 which receives the spout.
Figure 9:
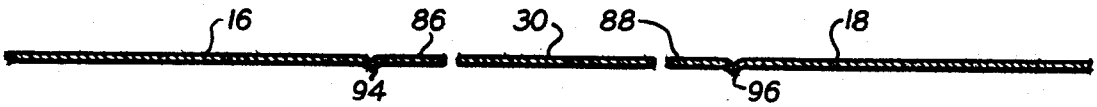
FIGS. 9, 10, 11 and 12 are partial cross sectional views of portions of the carton and spout and illustrates the method of constructing the wiper means which seal the edges of the spout.
Figure 10:
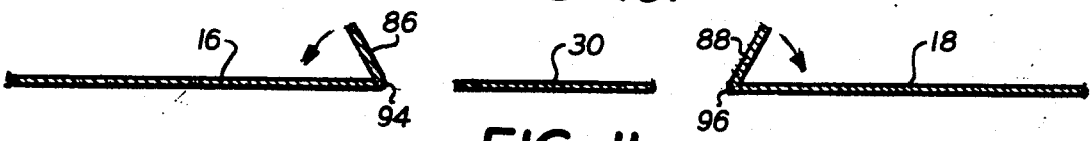
Figure 11:
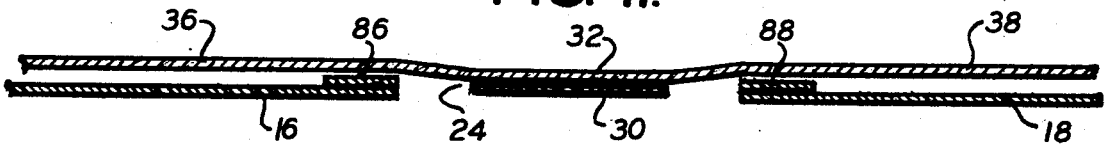

Still further leakage at the side walls 36 and 38 is prevented by a wiper-seal construction which is best described with reference to FIGS. 7 and 9–12. Referring first to FIG. 7, two sections 86 and 88 immediately adjacent the support piece 30 are die cut and separated from this piece at edges 90 and 92 respectively. Both of these sections are adopted to rotate inwardly toward the interior of the carton by bending over fold or score lines 94 and 96 respectively. This is best shown in FIGS. 9 and 10. When the spout is placed in position during assembly with the carton, it is placed over sections 86 and 88 in the manner shown in FIG. 11. In this position, side walls 36 and 38 are flat and support piece 30 is glued to front wall 32. When the carton is erected for filling, these parts assume the arrangement shown in FIG. 12. As can be seen, the sections 86 and 88 contact the side walls 36 and 38 in a manner which prevents leakage of the carton contents 84 at these side walls. The resiliency of sections 86 and 88 coupled with the wedge fit of the spout over these sections causes a frictional engagement to occur and a tight seal results. Additionally, the sections 86 and 88 act as wiper arms as the spout moves into and out of the carton. Further sealing is accomplished due to the contents of the carton wedging themselves between the side wall of the carton and the sections 86 and 88 as clearly shown in FIG. 12.

Figure 8:
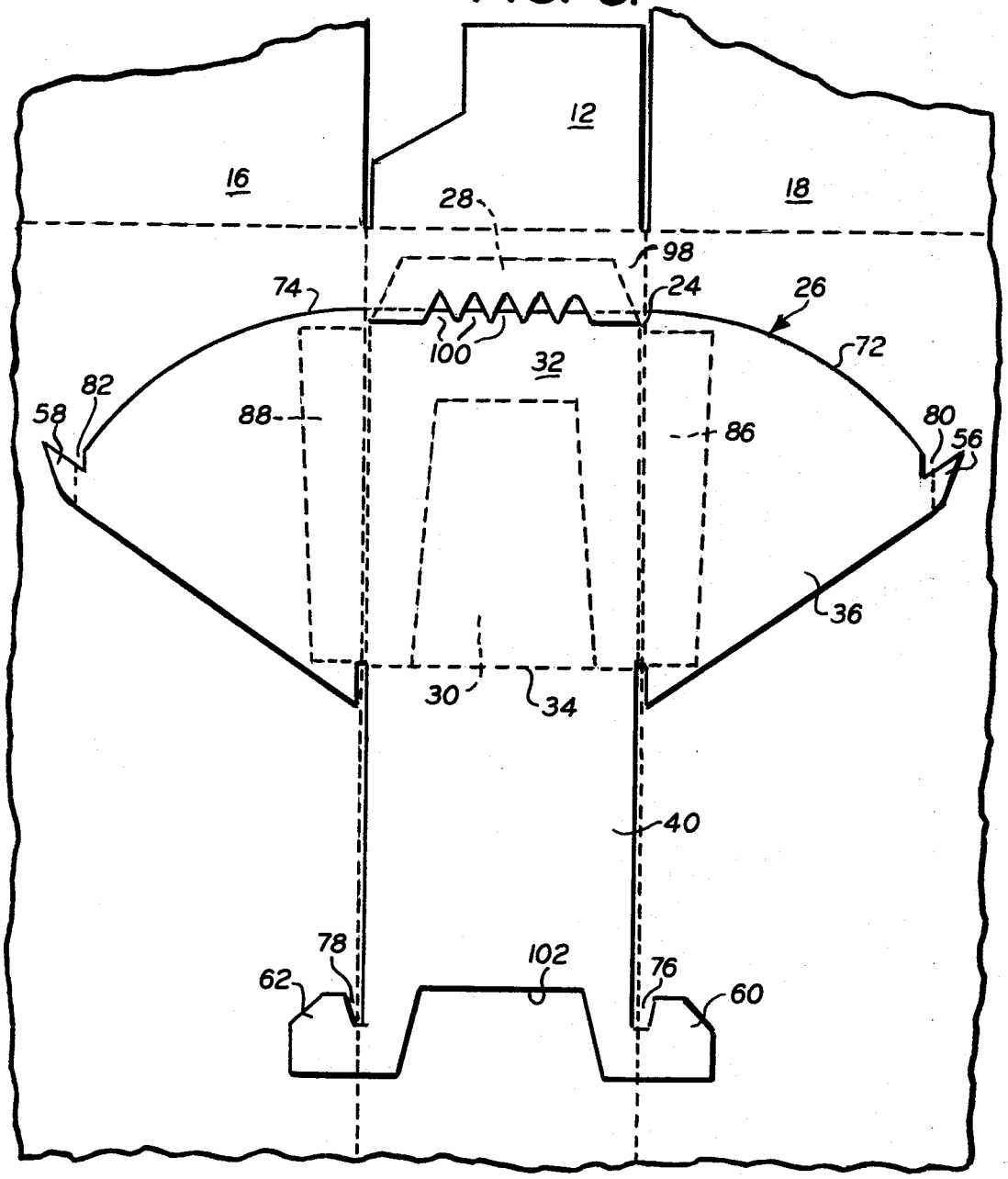
FIG. 8 is a plan view of the portion of carton shown in FIG. 7 with the spout as shown in FIG. 6 secured in place.
Figure 12:
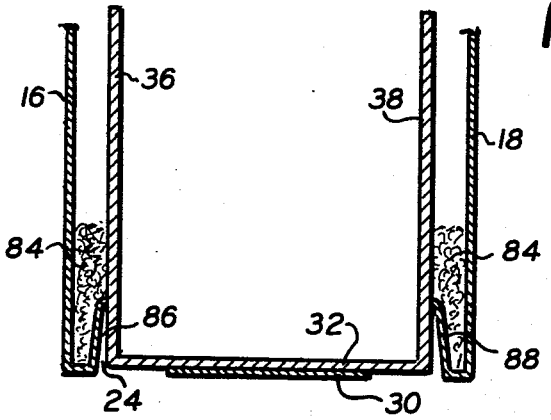

The assembly of carton and spout may be accomplished in several ways, each of which may be carried out while the carton is passing through the gluing and score breaking process. The first method of joining spout and carton includes a prearrangement of the spout either manually or automatically so that the spout assumes the configuration shown in FIG. 4. With the sides 36 and 38 held in the position shown there, the spouts will easily stack within a hopper type arrangement where they are fed onto the moving carton blanks. The carton blanks are folded so that sections 86 and 88 are separated sufficiently to guide spout side walls 36 and 38 between them (FIG. 12). Front wall 32 is glued to support piece 30 and lip 28 on the spout passes beneath overhanging portion 98 on panel side 12 and registers against this portion 98 (FIG. 8). The side walls of the spout may now lie flat relative to carton panels 16 and 18 as the carton continues to move through the gluing machine in a conventional manner.

In a second method of assembly, a flat, unfolded spout piece as shown in FIG. 6 is fed from a hopper onto the moving carton blank while at the same time the sections 86 and 88 are pushed by rollers and fingers to a position 180° from their original blanked out position. The spout piece is forced into position so that tab 28 fits under and in registration with overhang portion 98 as before described (see FIGS. 8 and 11 for an illustration of this position). The carton and spout are then passed along the gluing belt through a set of fingers which will cause side walls 36 and 38 to assume their right angle position as well as pick up rear wall 40 at tabs 60 and 62 and move it past tabs 56 and 58 and down flat against front wall 32. The carton then proceeds through the usual score breaking and gluing process.

Two additional design features of the carton of the invention further enhance its overall advantageous performance. As best illustrated in FIGS. 7 and 8, the overhanging portion 98 of side panel 12 is notched 100 at its lower edge. The notches minimize the friction and "packing up" of the contents of the carton behind portion 98 as well as allows the carton to breath so that air which is slightly compressed within the carton by the user's handling may escape easily thereby minimizing blowing of product from the spout when it is filled. A second feature is the opening 102 at the top of rear wall 40. This opening which is cut into this wall a distance equal to the desired fill line of the container allows rapid filling of the spout container and eliminates packing up of the product behind overhanging portion 98. In addition, this opening 102 permits free flow of material past rear wall 40 when the spout is in a free flow position (a position of the spout between its fully external and fully internal position).

From the foregoing, it will be appreciated that the carton and spout of the invention will satisfy both manufacturer and consumer alike since its highly advantageous features eliminate virtually all prior art problems with one single construction. The costs of manufacturing the spout unit are minimal since the spout may be die cut and scored in one piece while the costs of assembling the spout piece into the carton are also low. The finished carton is completed with the spout piece folded within and by shipping the assembly with carton flat and open at both ends (industry standard) there is no additional shipping or warehouse costs involved as the spout requires no extra volume. There are no voids within the carton due to the spout during the filling step. The spout may be used to free pour the carton's contents or may be used as a measuring device to dispense only prescribed portions at each use. A complete seal is effected before, during, and after pouring thereby eliminating leakage. All of these advantages as well as others are provided by the carton of this invention.

It will be appreciated that a number of modifications may be made without departing from the spirit of the invention.

What is claimed is:

1. A carton for housing materials such as laundry soap, detergents, powdered milk and the like comprising a plurality of side panels and top and bottom panels for forming an enclosed carton, one of said panels having an opening therein, spout means received in said opening, said spout means comprising a front, a rear and two side walls adapted to form a spout container for holding said material, means for rotatably securing said spout means to said carton thereby to permit said spout means to move into and out of said carton upon the application of an external force, said front wall of said spout being adapted to seal said opening when said spout means is moved to a position fully within said carton and said rear wall being adapted to seal said opening when said spout means is moved to a position fully external to said carton, and wiper means operatively connected to said carton internally thereof and engaging said side walls of said spout means when said spout means moves from within said carton, thereby to form a seal at the side walls of said spout means effective to prevent leakage of material at said side walls, wherein said wiper means comprise two segments of said carton, each segment extending along an edge of said opening in said carton, said segments being folded along their length away from said opening inwardly of said carton.

2. In the carton of claim 1, an opening in said rear wall at about the central portion thereof and extending downwardly from the upper edge thereof, said opening being positioned to facilitate passage of the contents of said carton over said rear wall during the operation thereof.

3. A carton for housing dry, flowable materials comprising a plurality of side, top and bottom panels arranged to provide a conventional enclosure, one of said panels having an opening therein, a pour spout positioned within said opening, said pour spout comprising a front wall, a rear wall and two side walls, said front wall being positioned externally of said carton and having at least a portion thereof extending beyond said opening thereby maintaining said front wall in an external position during operation of said spout, said rear wall being positioned internally of said carton and having at least a portion thereof extending beyond said opening thereby maintaining said rear wall within said carton during operation of the spout, means operatively connected between said front wall and said rear wall and effective upon the application of a force to said rear wall to permit said rear wall to rotate toward and away from said front wall, locking means operatively connected to said side walls and said rear wall and effective to lock said rear wall to said side walls when said rear wall is rotated away from said front wall thereby to form a spout container for holding the contents of said carton, means operatively connected to said front wall and effective to rotatably secure said spout to said carton whereby said spout is rotatably movable into and out of said carton as a unit, wherein said rear wall is provided with a pair of tabs, spaced from each other, each of said tabs having a groove therein, each of said side walls being slidably positioned within a groove thereby guiding said rear wall when it is moved toward and away from said front wall, wherein each side wall includes a projection extending therefrom, said projections being positioned on said side walls at a location spaced from said front wall and being effective to prevent said rear wall from moving beyond such location when travelling away from said front wall, wherein each of said side walls is provided with a channel at the edge over which said tabs on said rear wall slide, said channel being positioned between said front wall and said projections and being configured to receive said tabs in an interlocking engagement thereby to lock said rear wall to said side walls at said channels, and having an opening in said rear wall between said tabs and extending downwardly away from said tabs, said opening being positioned to facilitate passage of the contents of said carton over said rear wall during the operation thereof.

4. In the carton of claim 3, wiper means operatively connected to said carton internally thereof and engaging said side walls of said spout means when said spout means moves from within said carton, thereby to form a seal at the side walls of said spout means effective to prevent leakage of material at said side walls.

5. The carton of claim 4, in which said wiper means comprise two segments of said carton, each segment extending along an edge of said opening in said carton, said segments being folded along their length away from said opening inwardly of said carton.

6. The carton of claim 5, in which said spout means comprises a single unitary piece having a plurality of fold means, said piece being adapted to be folded from a flat unit into said spout container by a force applied at said fold means.

7. In the carton of claim 6, lip means operatively connected to said front wall and effective to provide a grasping surface for the application of an external force to said spout means.

8. A carton for housing materials such as laundry soap, detergents, powdered milk and the like comprising a plurality of side panels and top and bottom panels for forming an enclosed carton, one of said panels having an opening therein, spout means received in said opening, said spout means comprising at least a front and two side walls adapted to form a spout, means for rotatably securing said spout means to said carton thereby to permit said spout means to move into and out of said carton upon the application of an external force, said front wall of said spout being adapted to seal said opening when said spout means is moved to a position fully within said carton and stopping means adapted to prevent said spout means from disengaging from said opening in said panel of said carton when said spout means is moved to a position fully external to said carton, and wiper means operatively connected to said carton internally thereof and engaging said side walls of said spout means when said spout means moves from within said carton, thereby to form a seal at the side walls of said spout means effective to prevent leakage of material at said side walls, wherein said wiper means comprise two segments of said carton, each segment extending along an edge of said opening in said carton, said segments being folded along their length away from said opening inwardly of said carton.

* * * * *